US007060335B2

(12) United States Patent
Ichinose

(10) Patent No.: US 7,060,335 B2
(45) Date of Patent: Jun. 13, 2006

(54) RECORDING MEDIUM, METHOD OF MANUFACTURING THE SAME AND IMAGE FORMING METHOD

(75) Inventor: Hirofumi Ichinose, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 370 days.

(21) Appl. No.: 09/742,325

(22) Filed: Dec. 22, 2000

(65) Prior Publication Data

US 2003/0049414 A1 Mar. 13, 2003

(30) Foreign Application Priority Data

Dec. 27, 1999 (JP) ..... 11-370098

(51) Int. Cl.
*B41M 5/00* (2006.01)
*B41M 3/12* (2006.01)
*B41J 2/01* (2006.01)

(52) U.S. Cl. ..... 428/32.32; 428/32.15; 428/32.21; 347/105; 347/106; 427/146

(58) Field of Classification Search ..... 428/32.25, 428/32.15, 32.18, 32.21, 32.32
See application file for complete search history.

(56) References Cited

U.S. PATENT DOCUMENTS

| | | | | |
|---|---|---|---|---|
| 4,460,637 | A | 7/1984 | Miyamoto et al. | 428/212 |
| 4,723,129 | A | 2/1988 | Endo et al. | 346/1.1 |
| 5,523,149 | A | 6/1996 | Kijimuta et al. | 428/307.3 |
| 2003/0099816 | A1* | 5/2003 | Liu et al. | 428/195 |

FOREIGN PATENT DOCUMENTS

| | | | | |
|---|---|---|---|---|
| DE | 3237381 | A1 | | 7/1983 |
| EP | 0 749 845 | A3 | | 12/1996 |
| EP | 0 756 941 | A2 | | 2/1997 |
| JP | 54-059936 | | | 5/1979 |
| JP | 58-110287 | A | | 6/1983 |
| JP | 59-9516 | | | 1/1984 |
| JP | 59-038087 | | | 3/1984 |
| JP | 59-95186 | A | | 6/1984 |
| JP | 363162275 | A | * | 7/1988 |
| JP | 3-26665 | | | 4/1991 |
| JP | 403218885 | A | * | 9/1991 |
| JP | 7-76161 | A | | 3/1995 |

* cited by examiner

*Primary Examiner*—Pamela R. Schwartz
(74) *Attorney, Agent, or Firm*—Fitzpatrick, Cella, Harper & Scinto

(57) ABSTRACT

A recording medium comprises a base member mainly made of pulp fibers and an ink receiving layer formed thereon containing an inorganic pigment and a binder. The recording medium shows a pore radius distribution having a peak attributable to pores in the base member and a peak attributable to pores in the ink receiving layer. The peak attributable to pores in the ink receiving layer is located between 8 and 50 nm. The ink receiving layer is formed on the base member by applying a coating formulation containing at least an inorganic pigment and a resin emulsion to the base member at a coating rate between 1 and 10 g/m$^2$ so that the inorganic pigment and the resin emulsion become weakly agglomerated. The recording medium can be suitably used with an ink-jet recording system.

16 Claims, 4 Drawing Sheets

RECORDING MEDIUM, METHOD OF MANUFACTURING THE SAME AND IMAGE FORMING METHOD

BACKGROUND OF THE INVENTION

1. Field of the Invention

This invention relates to a recording medium having a texture like that of paper made of pulp fibers, a good ink absorbing effect and physical properties that make the recording medium good for being written on with a pencil. Such a recording medium can suitably be used for color recording using aqueous ink and particularly for color recording using an ink-jet recording method. The present invention also relates to a method of manufacturing such a recording medium and an image forming method for forming images by using such a recording medium.

2. Related Background Art

Ink-jet recording systems are adapted to record images and/or characters on a recording medium (such as paper) by ejecting fine droplets of ink based on any of the currently known various operation principles. An ink-jet recording system provides advantages including high speed printing, a low noise emission level, adaptability to multi-color printing, versatile recording pattern forming capabilities and elimination of development and fixing processes and therefore has been finding an increasingly large number of applications. Furthermore, currently known multi-color ink-jet recording systems can form multi-color images with an image quality comparable to that of color images printed by using a conventional printing system of preparation type or a color photography system at cost-lower than ordinary color printing if the number of copies is relatively small. Therefore, they are being used also in the field of full color image recording.

While improvements have been made to ink-jet recording apparatus and ink-jet recording methods to meet the demand for a higher recording speed, a higher image definition and a full color printing, such a rigorous demand has also been directed to the recording medium to be used for ink-jet recording. For the ink-jet recording system, ink containing an aqueous solvent that may be water or a mixed solution of water and an organic solvent to a large extent is normally used because ink droplets have to be ejected at high speed from nozzles toward the recording medium. For recording color images with a high color density, it is therefore necessary to use ink at a high consumption rate. On the other hand, the beading phenomenon of combined and fused ink dots can appear to disturb the image printing operation because ink droplets are ejected continuously. In order to prevent the beading phenomenon, the recording medium to be used with the ink-jet recording system is required to absorb ink at a high rate and to a large extent.

Various forms of recording mediums have been proposed to meet the above-listed requirements. For instance, there are two known types of ink-jet recording sheets including the ordinary paper type such as wood-free paper and bond paper and the coated type having an ink receiving layer (film coat) formed on a support member (to be referred to as base paper or base member hereinafter) that may be a sheet of paper such as wood-free paper, synthetic paper or synthetic resin film. The coated type may be subdivided into the low coating rate type with a coating rate between 1 and 10 g/m2, the medium coating rate type with a coating rate between 10 and 20 g/m$^2$ and the high coating rate type with a coating rate higher than 20 g/m2.

While ink-jet recording sheets with a coating rate equal to or higher than that of the medium coating rate type are adapted to produce fine and sharp images by ink-jet recording, the texture and other physical properties of the base paper are lost to some extent due to the thick coat layer. Additionally, they do not have physical properties that make them good for being written on with a pencil. For these reasons, there is a demand for a recording medium of the low coating rate type that has an agreeable texture and other physical properties including being good for being written on in pencil, and is still adapted to produce fine and sharp images.

In the case of a recording medium of the low coating rate type, it is difficult for the ink receiving layer to absorb all the ink applied to it and the base paper has to be made responsible for part of the applied ink. For example, Japanese Patent Publication No. 3-26665 and Japanese Patent Applications Laid-Open Nos. 59-38087 and 59-95186 describe the use of base paper showing a low Stöckgt sizing degree. When a base member showing a low Stöckgt sizing degree is used, no spills and blurs of ink nor the so-called beading phenomenon of producing agglomeration of ink and resultant uneven printing occur on the surface because the high ink absorbability of the base member is exploited.

On the other hand, however, with any known recording medium of the low coating rate type, ink can penetrate deep into the inside of the base member to make it impossible to raise the density of the recorded image. Since the known recording medium of the low coating rate type uses base paper showing a relatively low sizing degree and the ink absorbability of the recording medium mainly relies on the base paper itself, the fiber coating ratio of the ink receiving layer is insufficient and pulp fibers can be remarkably exposed on the surface of the recording medium if the coating rate is low and the coating formulation cannot be applied uniformly to undulated areas where pulp fibers of the base paper are intertwined. When an image is formed on such a recording medium particularly by using aqueous ink, ink can be dispersed along coarse pulp fibers to give rise to a phenomenon of feathering from the periphery of printed dots to make it impossible to produce really circular dots.

Japanese Patent Publication No. 63-22997 described a technique of forming an ink receiving layer on the surface of a support member, making the pore size distribution curve of the uppermost layer show a peak between 0.2 μm and 10 μm and regulating the peaks of the entire ink receiving layer so as to be well balanced. With this technique, pores having a large pore radius between 0.2 μm and 10 μm are formed in the uppermost layer without fail. Then, a high absorptive power (ink absorption rate) is secured mainly by the double layer structure. However, the above technique cannot make the base sheet fully exhibit its physical properties including the texture and the color tone. Additionally, since it does not exploit the gap structure of the base paper, a satisfactory ink absorbing effect cannot be achieved depending on the Stöckigt sizing degree and the surface profile of the base paper.

SUMMARY OF THE INVENTION

In view of the above-described circumstances, it is therefore an object of the present invention to provide a recording medium that is free from the above-identified problems of the prior art, has physical properties that make it good for being written on with pencil and shows an excellent ink absorbing effect without relying largely on the absorptive power of the base paper and a high ink absorption rate without damaging the natural texture of the base paper, while it is adapted to high speed printing with a reduced number of passes and provides a high image density, a sharp color tone and a high resolution. Another object of the present invention is to provide a recording medium showing such excellent properties even if any of various known different base member members (in terms of Stöckigt sizing degree and surface profile) were used.

According to the invention, the above object and other objects of the invention are achieved by providing a recording medium comprising a base member mainly made of pulp fibers and an ink receiving layer formed thereon and containing an inorganic pigment and a binder, the coating rate of the ink receiving layer being between 1 and 10 g/m$^2$, the pore size distribution of the recording medium having both a maximum value of pore radius of the base member and a maximum value of pore radius in the ink receiving layer, the maximum value of pore radius of the ink receiving layer being in the range between 8 nm and 50 nm.

According to the invention, there is also provided a method of manufacturing such a recording medium and an image forming method using such a recording medium.

DESCRIPTION OF THE PREFERRED EMBODIMENTS

Now, the present invention will be described in greater detail by way of preferred embodiments.

Figure 1:
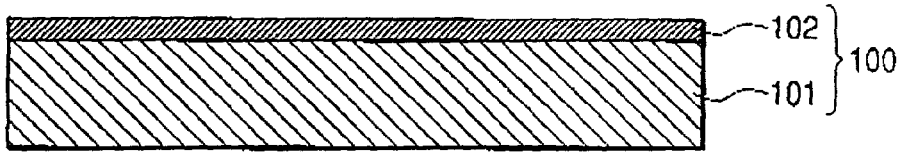
FIG. 1 is a schematic cross-sectional view of an embodiment of a recording medium according to the invention.

FIG. 1 is a schematic cross sectional view of an embodiment of recording medium according to the invention. Referring to FIG. 1, the recording medium 100 comprises a base member 101 and an ink receiving layer 102 formed on it. Any commercially available ordinary paper that is mainly made of pulp fibers can be used for the base member practically without limitations. For instance, an appropriate material that mainly contains pulp fibers and a filler and is used for making paper may also be used to produce the base member by a known paper making method. Any pulp fibers that are normally used for making paper may also be used for the purpose of the invention. For instance, chemical pulp such as LBKP and NBKP, mechanical pulp, recycled pulp, non-wood pulp and a mixture of two or more than two of them may be used.

Any ordinary method of making paper may be used for making the base member. For example, it may be formed by using pulp fibers and a filling material as the main ingredient and adding, if necessary, a sizing agent and a paper-making aid. Filling materials that can be used for the purpose of the invention include calcium carbonate, kaolin, talc and titanium dioxide, of which kaolin is particularly preferable.

Sizing agents that can be used for the purpose of the invention include rosin size, alkylketene dimer, alkenylsuccinic anhydride, petroleum resin size, epichlorohydrin and acrylamide. The gap-containing structure of the base member that is prepared by using pulp fibers as the main component is highly effective when it is used for a recording medium for ink-jek recording. The gap-containing structure of the base member preferably shows a pore size distribution in which the pore radius has a maximum value somewhere between 500 nm and 10,000 nm, preferably between 1,000 nm and 5,000 nm. The gap-containing structure may be regulated appropriately by controlling paper-making conditions, the type of pulp and the compounding ratio. The base member may not be able to absorb the ink solvent if the pore radius of the base member is too small. On the other hand, it may be difficult to properly support the ink receiving layer on the surface if the pore radius of the base member is too large. Then, problems such as unevenly printed letters, local ink overflows, blurs and a low density of printed areas may occur.

While there are no specific limitations to the Stöckigt sizing degree of the base paper of a recording medium according to the invention, it is preferably regulated to between 10 and 400 seconds when reduced to the basis weight of 127 g/m$^2$. The base member absorbs ink only insufficiently if the Stöckigt sizing degree is higher than the above range, whereas problems such as feathering and a low density of printed areas occur to reduce the quality of printing if the Stöckigt sizing degree is lower than the above range.

For the purpose of providing the base member with colors and a specific texture in various different ways, it may be colored partially with one or more than one dyes, pressed, embossed and/or streaked in order to turn it into a specifically designed or patterned item and make it attractive in terms of color tone, gloss and appearance.

A recording medium according to the invention has an ink receiving layer formed on the base member. The ink receiving layer 102 is realized in the form of a micro-porous thin film obtained by combining an inorganic pigment and a binder. When a recording medium 100 according to the invention and having such a configuration is used for recording with ink, the ink solvent is firstly drawn into the voids contained in the ink receiving layer 102 and eventually gets to and becomes absorbed by the base paper 101 due to the capillary effect. Since the ink receiving layer 102 is a microporous thin film, bleeding can hardly occur as its surface catches and adsorbs the coloring agent of ink and quickly transfers the ink solvent to the base paper.

Figure 2:
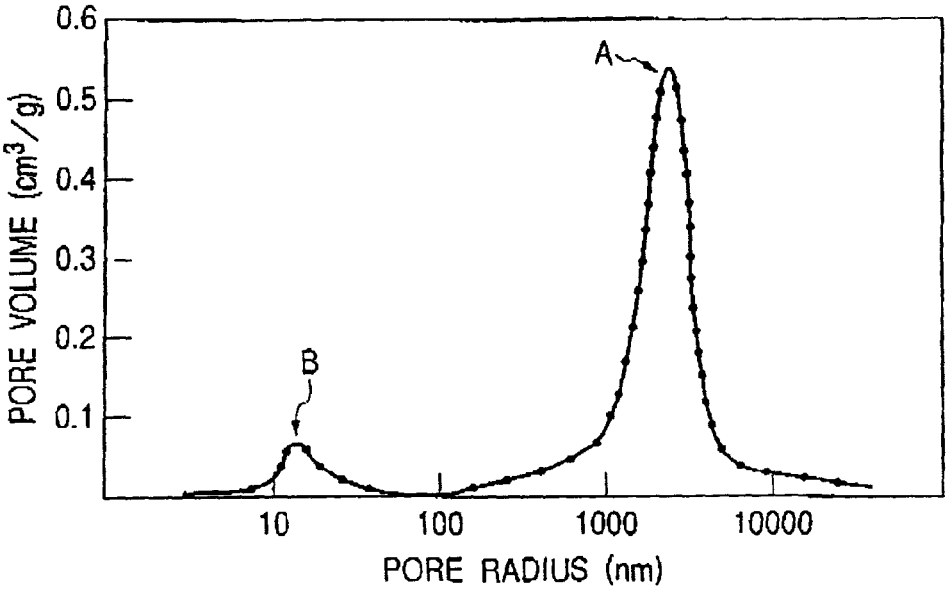
FIG. 2 is a graph of the pore size distribution curve of an embodiment of a recording medium according to the invention.

As for the size of the voids in the ink receiving layer 102 of a recording medium according to the invention, the pore size distribution curve of the recording medium shows peak B in addition to peak A that is attributable to the voids of the base paper as shown in FIG. 2. The peak B is attributable to the pores of the ink receiving layer. In a recording medium according to the invention, the peak B is made to show a maximum value found within a pore size range between 8 nm and 50 nm. The ink absorbing rate of the ink receiving layer is reduced and ink is absorbed only insufficiently and unevenly to give rise to overflows of ink and a stripy unevenness of printing particularly when it is used for high speed printing with a small number of passes if the peak B attributable to the voids of the ink receiving layer 102 is found at a pore size smaller than 8 nm, whereas the ink dots of the formed image can expand and bleed if the peak B is found at a pore size greater than 50 nm, because the ink receiving layer is no longer a micro-porous film. Then, the film coat (ink receiving layer) loses at least some of its transparency and it is no longer possible to produce a sharp image there. Thus, in order to make the ink receiving layer 102 absorb ink satisfactorily and show a sufficient level of transparency, the above described peak B is preferably found within a pore size range between 10 nm and 30 nm.

The ink-absorbing capacity of the pores (the volume of the pores) formed in the ink receiving layer can be regulated appropriately by controlling the types and the compounding ratio of the inorganic pigment and the binder of the ink receiving layer and also the film thickness of the ink receiving layer. Particularly, in order for the ink receiving layer to temporarily receive and hold the solvent of the ink applied to the recording medium and quickly transfer it to the base member mainly made of pulp fibers, the total volume of the pores having a radius between 8 nm and 50 nm is preferably greater than 0.005 $cm^3/g$, more preferably greater than 0.01 $cm^3/g$. The upper limit of the total volume should be such that the strength and the transparency of the ink receiving layer may not be undesirably reduced and the texture of the base member may be maintained with the volume. Specifically, the total volume of the pores is preferably smaller than 0.1 $cm^3/g$. Note that the vertical transfer of ink of the ink receiving layer can be appropriately secured by increasing the radius and the volume of the pores of the base member. The vertical transfer of ink is accelerated when the ratio of the total pore volume of ink receiving layer to that of the base member is smaller than 1/10, more preferably between 1/20 and 1/50. The ink-absorbing capacity of the pores of the ink receiving layer can be obtained by subtracting the pore size distribution curve after coating from that before coating.

The term "voids" as used herein refers to a pore structure formed in the ink receiving layer where pores are linked vertically and horizontally to produce a two-dimensional or three-dimensional pore arrangement. With such a pore structure, the solvent of the ink applied to the ink receiving layer can quickly pass through the pores to get to the base paper.

For the purpose of the present invention, the pore size distribution of the ink receiving layer 102 is determined by a mercury penetration method.

The ink receiving layer of a recording medium according to the invention can be made to have a pore structure that assures the ink receiving layer to show a satisfactory ink-absorbing effect by appropriately selecting the type of the inorganic pigment and that of the binder of the ink receiving layer as well as the compounding ratio thereof, the drying conditions for forming the film, the film thickness and so on. Then, the ink receiving layer will allow the ink solvent to pass therethrough and become absorbed.

The ratio of the surface area of the base member covered by the ink receiving layer 102 to the total surface area of the base member is preferably 90% or more. More preferably, the entire surface of the base member is covered by the ink receiving layer and hence is not exposed at all. Then, the ink receiving layer can reliably catch and absorb the coloring agent of ink to produce a uniform coloring effect and a high image density. If the ink receiving layer covers the base member to the above ratio, the base paper is exposed only slightly, if ever, so that the recording medium shows a uniform absorbability and, if ink overflows locally, the overflowing ink agglomerate on the surface and consequently the phenomenon of beading where dots of ink expand and become linked to each other can be effectively suppressed.

When the base paper is sufficiently covered by the ink receiving layer, fine cracks may well be formed on the surface of the ink receiving layer. The term "fine cracks" as used herein refers to small fissures formed on the surface of the ink receiving layer, although the shape and the width of such fine cracks are not defined specifically for the purpose of the invention. Both the ability of passing the ink solvent and that of absorbing ink of the ink receiving layer are improved by such fine cracks. While the size of such fine cracks is not defined specifically as pointed out above, there are preferably no fine cracks whose width is greater than 200 μm. Such cracks can be produced by rapidly heating and then cooling the coating formulation and/or by regulating the film coat. Furthermore, such fine cracks can be produced by compounding resins showing largely different glass transition temperatures and containing particles whose diameters differ largely from each other and appropriately selecting the type of the inorganic pigment and that of the binder as well as the compounding ratio thereof.

As for the film thickness of the ink receiving layer of a recording medium according to the invention, while it may have any value so long as the layer is formed by applying the coating formulation at a low rate of 1 to 10 $g/m^2$, it is preferably less than 5 μm from the viewpoint of securing a satisfactory absorptive power relative to ink, a sufficient film strength and physical properties that make it good for being written on with pencil. More preferably, the film thickness of the ink receiving layer is less than 2 μm to improve the texture of the base paper and the transparency of the film.

Now, the material of the ink receiving layer of a recording medium according to the invention will be described. Firstly, inorganic pigments that can be used for preparing the ink receiving layer include those that are used for the coat layer of ordinary coated paper. Specific examples of inorganic pigments that can be used for the purpose of the invention include, silica, alumina, alumina hydrate, calcium carbonate, zeolite, diatomaceous earth, kaolin, clay, baked clay, talc, aluminum hydroxide, colloidal alumina, barium sulfate, titanium dioxide, zinc oxide, zinc carbonate, magnesium silicate, magnesium carbonate and hydrotalcite. Any of such inorganic pigments can be used alone or two or more than two of them can be combined and used for the purpose of the invention. The use of silica or alumina hydrate is preferable from the viewpoint of making the ink receiving layer show a high degree of transparency and absorbability.

If silica is used, it may be natural silica, synthetic silica, noncrystalline silica or some other chemically modified silica type compound. For the purpose of the invention, the use of positively charged silica is preferable. Since alumina hydrate is positively charged, it can effectively fix the dye in ink to provide the image formed by using such ink with an enhanced degree of gloss and coloring effect. Particularly, the use of alumina hydrate is preferable because the ink receiving layer containing alumina hydrate is less hazy and more transparent than an ink receiving layer formed by using any other pigment.

The inorganic pigment to be used for the purpose of the present invention is selected from the above listed materials and preferably provided in the form of porous particles. In order for the ink receiving layer to show a desired pore radius and a desired pore volume, the use of an inorganic pigment having a BET specific surface area between 10 and 500 $m^2/g$ is preferable. If the BET specific surface area largely differs from the above range, it can be difficult to obtain a desired maximum value for the pore radius in the pore size distribution of the recording medium. The use of an inorganic pigment having a BET ratio surface area between 40 and 250 $m^2/g$ is more preferable for the purpose of the invention. Additionally, the pore volume of the inorganic pigment is preferably between 0.1 and 3.0 $cm^3/g$, more preferably between 0.3 and 1.0 $cm^3/g$.

The binder to be used with the inorganic pigment forming the ink receiving layer for the purpose of the invention is not subjected to any particular limitations in terms of water solubility, water dispersibility, the use of mixed resin of water and an organic solvent and so on. Preferable materials that can be used for the binder include polyvinyl alcohol, modified polyvinyl alcohol (obtained by using cationic modification, anionic modification or silanol modification), starch, modified starch, gelatin, modified gelatin, cellulose, gum arabic, cellulose derivatives such as carboxymethylcellulose, hydroxyethylcellulose and hydroxypropylmethylcellulose, conjugated diene type copolymer latex such as SBR latex, NBR latex and methyl methacrylate/butadiene copolymer, functional-group-modified polymer latex, vinyl type copolymer latex such as ethylene/vinyl acetate copolymer, polyvinylpyrrolidone, maleic anhydride, copolymer thereof and acrylic ester copolymer. Any of such binders can be used alone or in combination. Of the above binders, those in the form of latex emulsion provide preferable candidates from the viewpoint of forming pores of the desired size in the ink receiving layer because such binders are less prone to produce binder migrations when heated and dried.

Binder migrations are desiredly minimized to obtain pores to a sufficient extent. The use of a binder having a high glass transition temperature is effective for this purpose. For example, the use of emulsion type resin having a glass transition temperature between 20° C. and 120° C. will be highly effective. It can be difficult to suppress binder migrations by means of ordinary emulsion particles if the glass transition temperature is too low, whereas the film forming effect of the binder can be insufficient if the glass transition temperature is too high.

More preferably, a binder that is a heat-sensitive gelable resin emulsion is used for the purpose of the invention. When forming the ink receiving layer, the use of a binder containing an ingredient whose hydrophilicity and hydrophobicity are reversibly switched at a given temperature can effectively suppress binder migrations. When such a binder is used, it is not required to show a particularly high glass transition temperature, which may be within a range between −20° C. and 60° C.

When forming the ink receiving layer, pores can be optimally produced by forming a film coat, using inorganic particles and a binder in a weakly agglomerated state. Specifically, an inorganic pigment and a binder whose ionic properties are opposite to each other may preferably be used and weak agglomerates of such materials may be formed in the coating formulation in advance or after applying the formulation to the base member to produce optimal pores. A highly dispersive coating formulation can hardly produce optimal pores. Several techniques are conceivable for controlling the weakly agglomerated state of the materials of the ink receiving layer including that of a combined use of a strongly cationic inorganic pigment and a weakly anionic binder and that of a combined use of a weakly cationic inorganic pigment and a strongly anionic binder. Additionally, the weakly agglomerated state can be controlled by controlling the compounding ratio of the inorganic pigment and the binder or by adding a cationic substance. As the coating formulation turns into a film coat in a weakly agglomerated state, the gap structure of the present invention can be established due to the porosity of the inorganic pigment itself and by appropriately controlling the agglomerated state. If the materials of the ink receiving layer agglomerate strongly, it will be difficult to uniformly apply the coating formulation and the produced film coat will show an uneven ink absorbing effect and a reduced level of transparency.

When preparing the coating formulation for forming the ink receiving layer, the compounding ratio of the inorganic pigment and the binder is preferably between 2:1 and 10:1, more preferably between 3:1 and 7:1, in terms of solid components if the ink-absorbability, the film strength and the transparency of the ink receiving layer are taken into consideration. A satisfactory gap structure will not be produced if the compounding ratio exceeds the above range, or 2:1, whereas the film coat will not show satisfactory strength nor will the pores show a maximum value that is satisfactory for the purpose of the present invention because the number of bonds between the binder and the inorganic pigment is reduced if the compounding ratio falls under the above range, or 10:1.

When a cationic substance is added to the ink receiving layer, a cationic low molecular weight substance or a cationic high molecular weight substance is selected from those listed below. Specific examples of cationic low molecular weight substances that can be used for the purpose of the invention have a molecular weight less than 1,000 and include primary, secondary and tertiary amine salt type compounds such as hydrochlorides and acetates of lauryl amine, coconut amine, stearyl amine and rosin amine; quaternary ammonium salt type compounds such as lauryltrimethylammonium chloride, lauryldimethylbenzylammonium chloride, benzyltributylammonium chloride and benzalkonium chloride; pyridinium salt type compounds such as cetylpyridinium chloride and cetylpyridinium bromide; imidazoline type cationic compounds such as 2 heptadecenyl-hydroxyethylimidazoline; and ethylene oxide adducts of higher alkyl amines such as dihydroxyethylstearyl amine. Additionally, metal compounds may also be used as a cationic substance that is added to the ink receiving layer. Specific examples of metal compounds that can be used for the purpose of the invention include aluminum lactate, basic polyaluminum hydroxide, aluminum chloride, sodium aluminate and aluminum acrylate.

Specific examples of cationic high molecular weight substances that can be used for the purpose of the invention have a molecular weight more than 2,000 and include but are not limited to polyallylamine and hydrochloride thereof, polyamine sulfone and hydrochloride thereof, polyvinylamine and hydrochloride thereof and chitosan and acetate thereof. Cationic high molecular weight substances that can be used for the purpose of the invention are not limited to hydrochlorides and acetates. Additionally, nonionic polymeric substances that are partly cationized may also be used for the purpose of the invention. Specific examples of such substances include but are not limited to copolymer of vinylpyrrolidone and aminoalkyl alkyl ate quaternary salt and copolymer of acrylamide and aminomethylacrylamide quaternary salt.

As a matter of course, substances having a molecular weight between 1,000 and 2,000 and a mixture of any of the above listed substances may also be used for the purpose of the invention. While cationic substances that can be used for the purpose of the invention are preferably soluble in water and/or a mixed solution of water and an organic solvent, substances in a dispersed form of latex or emulsion may also be used for the purpose of the invention. The rate at which the selected additive is used is preferably such that the coloring component of ink is insolubilized and the ink receiving layer is made water-resistant while the inorganic pigment and the binder will neither agglomerate abnormally nor raise the viscosity and become subject to gelation. Specifically, the additive is preferably added to the ink receiving layer of the recording medium by such an extent that is found within a range between 0.1 and 6 $g/m^2$.

In order to allow ink to permeate into the ink receiving layer, a permeation aid may be added to the ink receiving layer. The permeation aid may typically be a surfactant. Examples of surfactants that can be used for the purpose of the invention include anionic surfactants such as carboxylates, sulfonates, sulfates and phosphates, cationic surfactants such as aliphatic amine salts, aliphatic quaternary ammonium salts, aromatic quaternary ammonium salts and heterocyclic quaternary ammonium salts, nonionic surfactants including those of the ether type such as polyoxyethylene alkyl ether, polyoxyethylene alkyl phenyl ether and polyoxyethylene polyoxypropylene block polymer, those of the ether-ester type such as polyoxyethylene glycerin fatty acid ester and polyoxyethylene sorbitan fatty acid ester, those of the ester type such as polyethylene glycol fatty acid ester, sorbitan fatty acid ester and sucrose fatty acid ester and those of the nitrogen-containing type such as polyoxyethylene fatty acid amine and polyoxyethylene alkylamine and amphoteric surfactants such as betaine, aminocarboxylic acid and imidazoline derivatives. Permeation aids other than surfactants may also be used for the purpose of the invention.

Thus, an ink receiving layer having a desired pore structure can be formed for a recording medium according to the invention by applying a coating formulation prepared by using an inorganic pigment, a binder and a cationic substance, to which, if necessary, a permeation aid is added, to a base member.

The coating formulation can be obtained by mixing the above ingredients to a desired ratio and dispersing and dissolving them in water by means of a known method. Dispersing methods that can be used for the purpose of the invention include the use of a dispersing machine such as a ball mill, an attritor, a sand mill, a homo-mixer, a Microfluidizer (tradename, available from Microfluidex) or Nanomizer (tradename, available from Nanomizer). As for the physical properties of the coating formulation, the viscosity, the pH and the dispersibility are important. While the viscosity of the coating formulation may be regulated depending on the technique to be used for applying the formulation, it is preferably between 3 cps and 500 cps. The pH of the coating formulation is preferably so regulated as to be found within a range between 3 and 7. The pH of the formulation can be measured by a method conforming to JIS Z8802.

Additionally, the coating formulation is required to provide a sufficient level of dispersibility and preservation stability in order to obtain a uniform film coat and satisfactory transparency. For this purpose, a dispersant, a thickening agent, a lubricant, a fluidity modifying agent, a surfactant, an anti foaming agent, a water-resisting agent, a foam inhibitor, a releasing agent and/or anti-mold agent may be added to the coating formulation to such an extent that the addition of any of such agents does not interfere with the object of the present invention.

Techniques that can be used for applying the coating formulation to the base member include blade coating, air-knife coating, roll coating, flash coating, gravure coating, kiss-roll coating, die coating, extrusion coating, a slide hopper system, curtain coating, spray coating, a size-press system, symsizer coating and gate roll coating, of which gravure coating, a size press system, symsizer coating, gate roll coating and an improved technique of any of them may preferably be used because of the ease of controlling the rate of application particularly when the rate of application is low or very low as in the case of the present invention. Additionally, after the application, the produced ink receiving layer may be finished by using a calender such as a machine calender, a super calender or a soft calender. For the purpose of the invention, the side of the base member (support member) opposite to the side carrying the ink receiving coat film may be provided with a back coat layer. The composition of the material of the back coat layer may be the same as or different from that of the material of the ink receiving layer and the rate and the technique of application for forming the back coat layer are not subjected to any specific limitations.

For the purpose of the invention, the ink receiving layer is produced by, if necessary, heating and drying the film coat formed on the base member in a manner as described above. As a result of the drying process, the aqueous medium (dispersant) evaporates and the binder is fused to firmly bind the components together and produce a film layer. The drying conditions may be selected appropriately depending on the composition of the coating formulation. A hot air drying furnace and/or an infrared ray drying furnace that are currently popular may be used for the drying process.

An image forming method according to the invention comprises applying ink to a recording medium according to the invention. Now, an image forming method according to the invention will be described below.

Firstly, ink to be used for the image forming method of the invention will be described. Of the purpose of the invention, ink containing a coloring agent (dye or pigment), a water-soluble organic solvent and water as principal ingredients is used. While a water-soluble dye that may be a direct dye, an acid dye, a basic dye, a reactive dye or a food dye is preferably used, a dye of any type may be used for the purpose of the invention so long as it can produce an image that is satisfactory in terms fixation, coloring, sharpness, stability, light-resistance and other requirements when combined with the recording medium. Examples of pigments that can be used for the purpose of the invention include inorganic pigments such as carbon black, organic pigments, metallic fine particles, metal oxides and various metal compounds.

The water-soluble dye is generally dissolved in an aqueous solvent that comprises water or a mixture of water and an organic solvent, which is preferably selected from various water-soluble organic solvents. The water content of ink is preferably so regulated as to be found within a range between 20 and 90 weight %.

Water-soluble organic solvents that can be used for the purpose of the invention include alkyl alcohols having 1 to 4 carbon atoms such as methyl alcohol, amides such as dimethyl formamide, ketones and ketone alcohols such as acetone, ethers such as tetrahydrofuran, polyalkylene glycols such as polyethylene glycol, alkylene glycols whose alkylene group has 2 to 6 carbon atoms such as ethylene glycol, glycerin and lower alkyl ethers of polyhydric alcohols such as ethylene glycol methyl ether.

Of such various water-soluble organic solvents, polyhydric alcohols such as diethylene glycol and lower alkyl ethers of polyhydric alcohols such as triethylene glycol monomethyl ether and triethylene glycol monoethyl ether are preferable for the purpose of the present invention. The use of a polyhydric alcohol is particularly advantageous because it operates as a lubricant for preventing the phenomenon of nozzle-clogging from taking place when the water in the ink evaporates to deposit at least some of the water-soluble dye in the ink.

A solubilizing agent may be added to ink. Typical solubilizing agents that can be used for the purpose of the invention include nitrogen-containing heterocyclic ketones because such agents can dramatically raise the solubility of the water-soluble dye to the solvent. For instance, N-methyl-2-pyrrolidone or 1,3-dimethyl-2-imidazolidinone may preferably be used for the purpose of the invention. Furthermore, any of the additives as listed below may be used to improve the performance of ink: a viscosity regulator, a surfactant, a surface tension regulator, a pH regulator and a specific resistance regulator.

An ink-jet recording method is preferably used when recording images by applying ink to a recording medium according to the invention, in the image forming method of the invention. Any ink-jet recording method can be used for the purpose of the invention if it can effectively release ink from a nozzle and apply ink to the recording medium, although the use of an ink-jet recording method with which ink abruptly changes its volume by thermal energy and becomes discharged from a nozzle by the force generated due to this change of state as disclosed in Japanese Patent Application Laid-Open No. 54-59936 may be a preferable choice.

With the image forming method of the invention for forming an image on a recording medium according to the invention with ink having a composition as described above, problems that arise when inks of different colors are used for solid images such as bleeding (blurred boundaries) of images and beading of ink droplets where ink oozes out to link ink droplets to each other can be remarkably alleviated because of the strong absorptive power of the recording medium relative to ink.

A recording medium according to the invention can be used not only as a recording sheet for ink-jet recording but also with any recording method that uses liquid ink for recording. For example, thermal transfer recording and photo-sensing/pressure-sensing recording may also be used with a recording medium according to the invention. Furthermore, a recording medium according to the invention can also be used for the recording method adapted to heat and fix toner for electro-photographic recording that is popularly utilized in copying machines and printers in recent years and for proof-reading applications in the field of printing using phototypesetting.

Now, the present invention will be described in greater detail by way of examples and comparative examples, although the present invention is by no means limited thereto.

EXAMPLE 1

Figure 3:
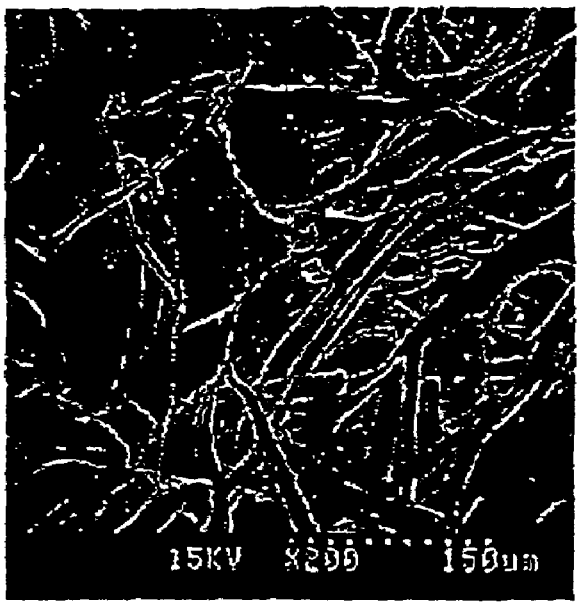
FIG. 3 is an illustrative copy of a microscopic photograph of the surface of the base paper used in examples and comparative examples as obtained by observing it through a scanning microscope.

A recording medium having a configuration as shown in FIG. 1 was prepared. More specifically, paper having a basis weight of 127 g/m$^2$ under the paper making conditions as listed below was used for the base member 101. The Stöckigt sizing degree was 120 seconds. The support member had a thickness of 127 μm. When the surface was observed through a scanning microscope (S000: tradename, available from Hitachi), pulp fibers were found as shown in FIG. 3. By measuring the pore size distribution of the base member by means of a mercury penetration method, using Autopore III 9420 (tradename, available from MICROMERITICS), a peak having its peak at the position of pore radius of 2,530 nm was found.

| | |
|---|---|
| NBKP compounding ratio | 40 weight portions |
| LBKP compounding ratio | 75 weight portions |
| filler (talc) | 4.0 weight portions |
| sizing agent (alkyleneketene dimer) | 0.4 weight portions |
| cationized starch | 0.5 weight portions |
| rate of size press application (polyacrylamide) | 2.5 weight portions |

Thereafter, a coating formulation was prepared by mixing the ingredients listed below and stirring well. After defoaming, it was applied to the paper operating as base member 101 by means of a gravure coater and dried in a hot air drying furnace at 120° C. to produce an ink receiving layer 102. The weight per unit area of the ink receiving layer 102 was 4 g/m$^2$ when dried.

The coating formulation used in this example will be described. In the table of composition shown below, the alumina hydrate used as inorganic pigment was prepared in the following manner. Firstly, aluminum dodexide was hydrolysed to produce alumina slurry. Water was then added to the alumina slurry until the solid content of alumina hydrate fell to 7.9%. Then, 3.9% aqueous solution of nitric acid was added to regulate the pH and, after an aging process, a colloidal sol was obtained. The colloidal sol was dried by spraying at a temperature of 75° C. to produce the powdery alumina hydrate used in this example. The alumina hydrate was dispersed into deionized water to produce a 15% dispersion. The alumina hydrate showed a BET specific surface area of 210 m$^2$/g and a pore volume of 0.627 cm$^2$/g.

| | |
|---|---|
| inorganic pigment (15% alumina hydrate solution) | 100 weight portions |
| binder (SBR latex, Tg = 40° C., particle diameter = 150 nm) | 10 weight portions |
| permeation aid (polyoxyethylene polypropylene condensate) | 4 weight portions |
| cationic substance (benzalkonium chloride) | 2.5 weight portions |
| water | 125 weight portions |

Figure 4:
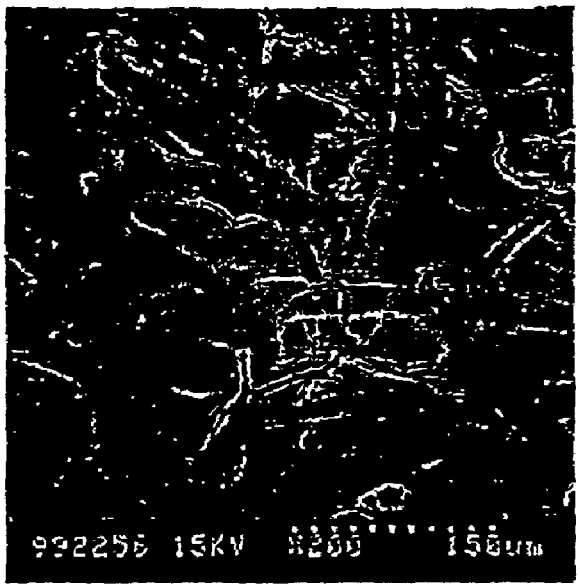
FIG. 4 is an illustrative copy of a microscopic photograph of the surface of the recording medium used in Example 1 obtained by observing it through a scanning microscope.
Figure 5:
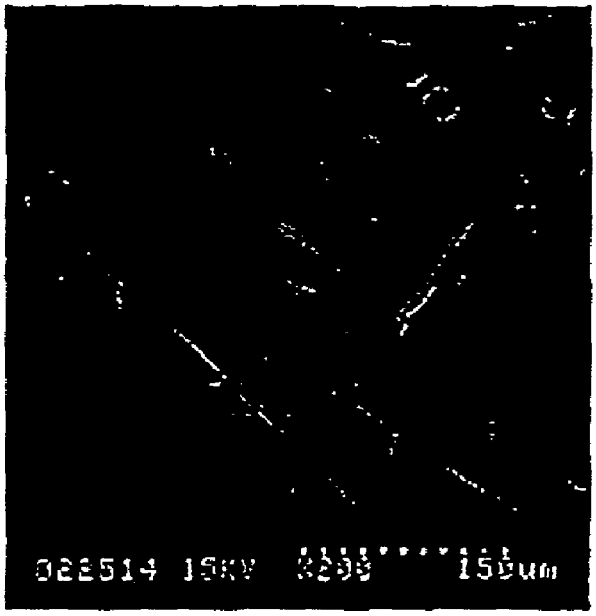
FIG. 5 is an illustrative copy of a microscopic photograph of the surface of the recording medium used in Comparative Example 1 as obtained by observing it through a scanning microscope.

The prepared ink receiving layer of the recording medium 100 was observed through a scanning microscope to find that the pulp surface was almost completely covered by the ink receiving layer as shown in FIG. 4. The ink receiving layer 102 on the surface was about 1.2 μm thick.

Figure 7A:
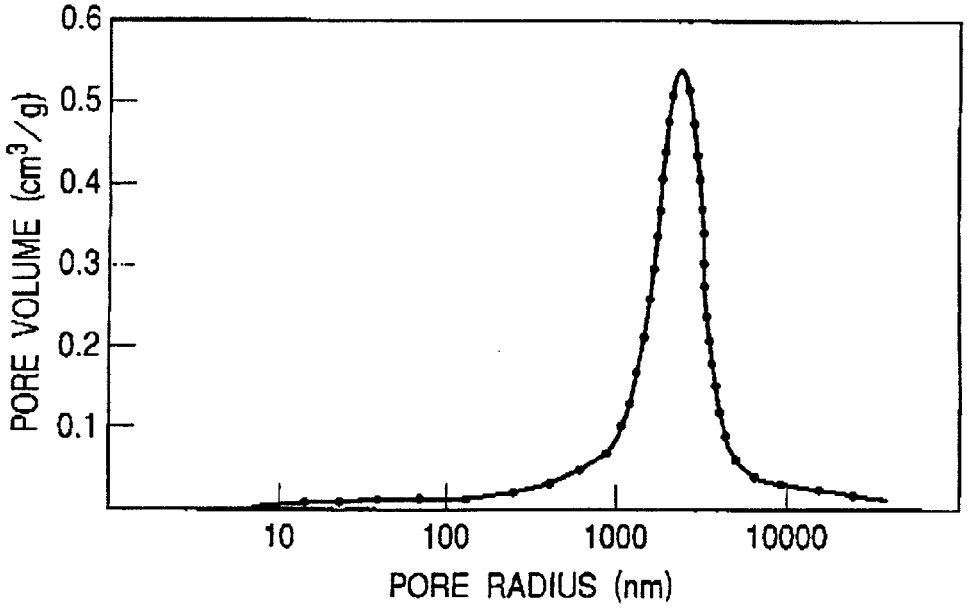
FIG. 7A is a graph of the pore size distribution curve of the base paper used for the recording medium of Example 1 of the present invention.
Figure 7B:
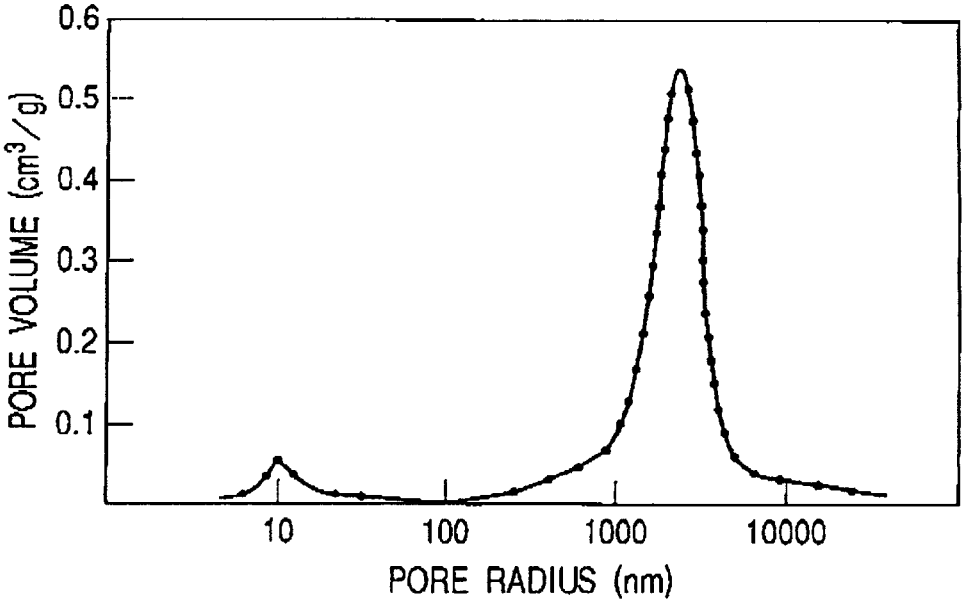
FIG. 7B is a graph of the pore size distribution curve of the base-paper-used recording medium of Example 1.

By measuring the pore size distribution, it was found that the pore size distribution curve had two peaks showing maximum values at respective positions of pore radius of 2,530 nm and that of 10.7 nm as shown in FIG. 7B. The pore volume of the ink receiving layer was calculated to be equal to 0.0059 cm$^3$/g from the peak of the base paper shown in FIG. 7A and the peaks of the ink receiving layer in FIG. 7B.

<Evaluation>

The obtained recording medium 100 was evaluated for the following test items. The results of the evaluation were listed in Table 1. To be more accurate, a number of specimens were prepared and evaluated and any one that was rated by x for at least one of the test items (1) through (4) was evaluated as no good while those that were without x rating were evaluated as good.

(1) Texture and Colors

The recording medium was visually observed and touched with finger tip to see if the texture and the colors that are proper to the base paper were maintained or not. Specimens whose texture and colors are good were rated as ○, whereas those whose texture and colors are not good were rated as x.

(2) Pencil Writing

The surface of the ink receiving layer of the recording medium was tested for performance when written on with pencil by writing letters by means of a pencil with a core hardness of HP. Specimens where written letters were not blurred were rated as ○, whereas those where written letters were blurred were rated as x.

(3) Powder Fall

The surface of the recording medium was rubbed with black paper and transfer (powder fall) of the ink receiving layer was tested. Specimens that showed no transfer (powder fall) of the ink receiving layer were rated as ○, whereas those that showed transfer (powder fall) of the ink receiving layer were rated as x.

(4) Printing Performance

An ink-jet printer comprising a number of drop on demand type ink-jet heads having nozzles arranged at regular intervals (600 dpi) at a rate of 24 nozzles per 1 mm, the number of nozzles being equal to the number of inks to be used for printing, and adapted to form an image by scanning perpendicularly relative to the row of the nozzles was used for an ink-jet recording operation using inks of different compositions as listed below. Each of yellow (Y), magenta (M), cyan (C) and black (Bk) inks were ejected at a rate of 10 pl per dot. The rate of ink consumption for single color printing conducted at a rate of 24×24 dots per 1 $mm^2$ (600 dpi×600 dpi) was regarded as 100%. Therefore, the rate of ink consumption for double color printing was a double of the rate of ink consumption for single color printing and hence regarded as 200%. Similarly, the ink consumption rate for triple color printing and the one for quadruple color printing were regarded respectively as 300% and 400%.

The following coloring agents were used; C. I. Direct Yellow 86 for Y ink, C. I. Acid Red 35 for M ink, C. I. Direct Blue 199 for C ink and C. I Food Black 2 for Bk ink. Then, each of the coloring agents were used to prepare three different inks with different dye concentrations for each color.

| | | |
|---|---|---|
| 1) | ink composition 1: | high dye concentration |
| | the dye | 3 portions |
| | diethyleneglycol | 5 portions |
| | polyethyleneglycol | 10 portions |
| | water | 82 portions |
| 2) | ink composition 2: | medium dye concentration |
| | the dye | 1 portion |
| | diethyleneglycol | 5 portions |
| | polyethyleneglycol | 10 portions |
| | water | 84 portions |
| 3) | ink composition 3: | low dye concentration |
| | the dye | 0.6 portions |
| | diethyleneglycol | 5 portions |
| | polyethyleneglycol | 10 portions |
| | water | 84.4 portions |

Then, ink sets of inks of four colors of yellow (Y), magenta (M), cyan (C) and black (Bk) prepared in the above described manner were used to print images on a recording medium according to the invention and evaluated for the following test items (a) through (d) that relate to the printing effect.

(a) Blurring, Bleeding, Beading, Repelling and Stripy Unevenness

Inks of ink composition 1 of four colors were used for printing in four passes and the ink consumption rate of ink of each color was changed from 100% (single color) to 400% (quadruple color). The printed image was visually checked for blurring, bleeding, beading, repelling and stripy unevenness. The following rating system was used.

No such defects occurred at ink consumption rate of 400%: ◎

No such defects occurred at ink consumption rate of 300%: ○

No such defects occurred at ink consumption rate of 100%: Δ

Such defects occurred at ink consumption rate of 100%: x (b) Image Density

The reflective image density of each of the images printed solidly by using high dye concentration inks with composition 1 of four colors at an ink consumption rate of 100% (single color) were observed by means of a densitometer (310TR: tradename, available from X-Rite) and the image density of each image was represented by the obtained numerical value for black color.

(c) Water-resistance

A solid pattern was printed on a sheet of recording medium according to the invention at an ink consumption rate of 200% for each color and left for a day to make the ink dry. Thereafter, a drop of pure water was dropped on the solid pattern to see if the ink flowed out or not. Sheets that showed no such ink flow were rated as ○, whereas those that showed such an ink flow were rated as x.

(d) High Speed Printing Performance

Each of high dye concentration inks of ink composition 1 was used to print solidly in a pass at an ink consumption rate of 200% and the printed pattern was visually observed along the boundary thereof for blurs, bleeding, beading, repelling and stripy unevenness. Specimens free from those problems were rated as ○, whereas those that showed any of such problems were rated as x.

COMPARATIVE EXAMPLE 1

In this example, a recording medium was prepared as in Example 1 except that the ink receiving layer 102 was formed by using alumina hydrate that was prepared in a manner as described below and water-soluble polyvinyl alcohol as binder and crosslinking them by means of boric acid. The obtained recording medium was used for image formation as in Example 1 and evaluated for items (1) through (4) above. The results are summarily shown in Table 1. The method described in Japanese Patent Application Laid-Open No. 7-76161 was used for forming the ink receiving layer.

Firstly, 2 g of a 5 wt % aqueous solution of $H_3BO_3$ was added to 100 g of boemite sol containing solid by 18.35 wt % that was synthetically formed from aluminum alkoxide by hydrolysis and deflocculation and heated to 40° C. The mixture product was further mixed with 20.2 g of a 10 wt % aqueous solution of polyvinyl alcohol (saponification value: 97%, degree of polymerization: 2,300) to produce a coating formulation containing solid by 16 wt %.

Then, the obtained coating formulation was applied to a base member, which was the same as the one used in Example 1, at a rate of 23 g/m$^2$ after drying by means of a bar coater and then dried in an oven at 65° C. The base member carrying the applied formulation was then heat treated at 140° C. to produce a recording medium carrying an ink receiving layer on the surface. The ink receiving layer of the recording medium was observed through a scanning electron microscope to find that the base member was covered to such an extent that the pulp surface was scarcely exposed. The film thickness of the ink receiving layer was as thick as 10.2 μm.

By measuring the pore size distribution, it was found that the pore size distribution curve had two peaks showing maximum values as in Example 1. The peak that appeared at the larger pore radius side was attributable to the voids of the base paper and showed a maximum value of 2,510 nm and the other peak was attributable to the pores of the ink receiving layer and showed a maximum value of 6.5 nm. The pore volume of the ink receiving layer was equal to 0.0050 cm$^3$/g. The above observation and measurement were conducted in the same manner as in Example 1.

COMPARATIVE EXAMPLE 2

Figure 6:
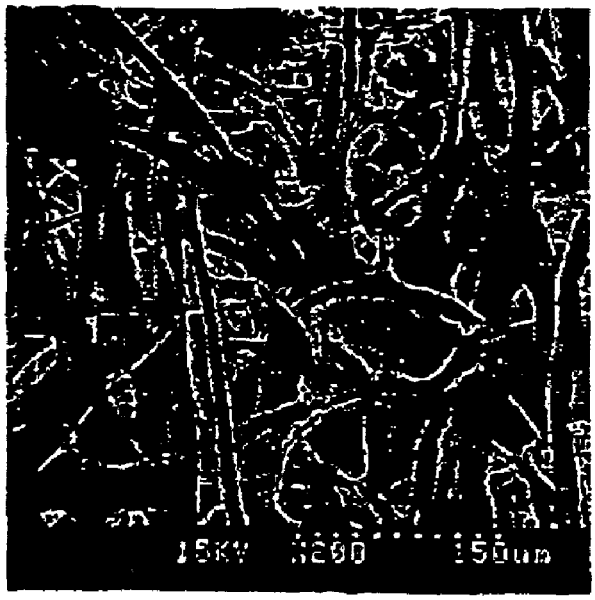
FIG. 6 is an illustrative copy of a microscopic photograph of the surface of the recording medium used in Comparative Example 2 as obtained by observing it through a scanning microscope.

Specimens of recording medium were prepared as in Example 1 except that they did not contain any binder. The obtained specimens were used for image formation as in Example 1 and evaluated for items (a) through (d). Table 1 summarily shows the results. The ink receiving layer of each of the specimens was observed through a scanning electron microscope to find that the alumina hydrate of the inorganic pigment had filled the gaps of the pulp fibers so that it did not practically cover the pulp surface as shown in FIG. 6. The film thickness was as thin as less than 1.0 μm.

By measuring the pore size distribution, it was found that the pore size distribution curve had two peaks showing maximum values. The peak that appeared at the larger pore radius side was attributable to the voids of the base paper and showed a maximum value of 2,510 nm and the other peak was attributable to the pores of the ink receiving layer and showed a maximum value of 6.8 nm. The pore volume of the ink receiving layer was equal to 0.00010 cm$^3$/g. The above observation and measurement were conducted in the same manner as in Example 1.

EXAMPLE 2

Specimens of recording medium were prepared as in Example 1 except that the ink receiving layer was formed by using a mixture of two types of alumina that were different in terms of BET specific surface area and pore volume. More specifically, the two types of alumina hydrate, or alumina hydrate A and alumina hydrate B, were prepared in a manner as described below by selecting different maturing conditions and pH values. The alumina hydrate A had a BET specific surface area of 219 m$^2$/g and a pore volume of 0.660 cm$^2$/g, whereas the alumina hydrate B had a BET specific surface area of 45 m$^2$/g and a pore volume of 0.490 cm$^2$/g. The alumina hydrate A and the alumina hydrate B were mixed at a mixing ratio of 3:1 in terms of weight.

The obtained specimens of recording medium were used for image formation as in Example 1 and evaluated for items (a) through (d). Table 1 summarily shows the results. By measuring the pore size distribution of the specimens, it was found that the pore size distribution curve had two peaks showing maximum values. The peak that appeared at the larger pore radius side was attributable to the voids of the base paper and showed a maximum value of 2,550 nm and the other peak was attributable to the pores of the ink receiving layer and showed a maximum value of 8.6 nm. The pore volume of the ink receiving layer was equal to 0.00580 cm$^3$/g. The above observation and measurement were conducted in the same manner as in Example 1.

EXAMPLE 3

Specimens of recording medium were prepared as in Example 1 except that the ink receiving layer was formed by using a heat-sensitive gelable resin emulsion whose hydrophilicity and hydrophobicity were reversibly switched at a given temperature. The heat-sensitive gelable resin emulsion was obtained by emulsifying a mixture of water-soluble urethane resin, SBR type latex and a polymer obtained by polymerizing 2 morpholinoethylmethacrylate and 2,2-azobis (2,4 dimethylvaleronitrile). The heat-sensitive gelable resin emulsion was gelable at about 50° C. to abruptly raise its viscosity.

The obtained specimens of recording medium were used for image formation as in Example 1 and evaluated for items (a) through (d). Table 1 summarily shows the results. By measuring the pore size distribution of the specimens, it was found that the pore size distribution curve had two peaks showing maximum values. The peak that appeared at the larger pore radius side was attributable to the voids of the base paper and showed a maximum value of 2,490 nm and the other peak was attributable to the pores of the ink receiving layer and showed a maximum value of 17.6 nm. The pore volume of the ink receiving layer was equal to 0.00709 cm$^{3/}$g. The above observation and measurement were conducted in the same manner as in Example 1.

EXAMPLE 4

Specimens of recording medium were prepared as in Example 1 except that the ink receiving layer was formed by using silica for the inorganic pigment. The silica showed a specific surface area of 145 m$^2$/g and a pore volume of 0.435 cm$^3$/g. The obtained specimens of recording medium were used for image formation as in Example 1 and evaluated for items (a) through (d). Table 1 summarily shows the results.

By measuring the pore size distribution of the specimens, it was found that the pore size distribution curve had two peaks showing maximum values. The peak that appeared at the larger pore radius side was attributable to the voids of the base paper and showed a maximum value of 2,490 nm and the other peak was attributable to the pores of the ink receiving layer and showed a maximum value of 26.6 nm. The pore volume of the ink receiving layer was equal to 0.00409 cm$^3$/g. The above observation and measurement were conducted in the same manner as in Example 1.

EXAMPLE 5

In this example, ink sets of pigment inks containing pigments as coloring agents were used for recording images on specimens of recording medium the same as those obtained in Example 1. The following coloring agents, or pigments, were used; C. I. Pigment Yellow 83 for Y ink, C. I. Pigment Red 48:3 for M ink, C. I. Pigment Blue 15:3 for C ink and carbon black for Bk ink. Then, each of the coloring agents was used to prepare three different inks with different colorant concentrations for each color.

The pigment inks were prepared firstly by preparing pigment dispersions using a dispersant as shown below and a known dispersion method. Then, each of the pigment dispersions was used to prepare different inks for each color.

| | |
|---|---|
| the pigment | 15 portions |
| copolymer of polyethylene glycol monoacrylate and sodium acrylate to which an oxyethylene radical was introduced by 45 mols [monomer mol ratio (the former/the latter) = 2/8] | 3 portions |
| monoethanol amine | 1 portion |

Inks with different pigment concentrations were prepared by using the above pigment dispersant solution.

| | | |
|---|---|---|
| 4) | ink composition 4: | high pigment concentration |
| | the pigment dispersion | 33 portions |
| | diethylene glycol | 4 portions |
| | deionized water | 63 portions |
| 5) | ink composition 5: | medium pigment concentration |
| | the pigment dispersion | 11 portions |
| | diethylene glycol | 4 portions |
| | deionized water | 85 portions |
| 6) | ink composition 6: | low pigment concentration |
| | the pigment dispersion | 6.6 portions |
| | diethylene glycol | 4 portions |
| | deionized water | 89.4 portions |

Then, ink sets of inks prepared in the above described manner were used for image formation and the obtained images were evaluated for the test items (a) through (d). Table 2 summarily shows the obtained results. As shown in Table 2, images formed by using pigment inks were as satisfactory as those formed by using dye inks in Example 1.

EXAMPLE 6

Specimens of recording medium were prepared as in Example 1 except that paper carrying an embossed pattern was used for the base paper. The obtained specimens of recording medium were used for image formation as in Example 1 and evaluated for items (a) through (d). Table 2 summarily shows the results.

By measuring the pore size distribution of the specimens, it was found that the pore size distribution curve had two peaks showing maximum values. The peak that appeared at the larger pore radius side was attributable to the voids of the base paper and showed a maximum value of 2,350 nm and the other peak was attributable to the pores of the ink receiving layer and showed a maximum value of 10.6 nm. The pore volume of the ink receiving layer was equal to 0.00429 $cm^3/g$. The above observation and measurement were conducted in the same manner as in Example 1.

As seen from Table 2, the recording medium of this embodiment produced by forming an ink receiving layer like that of Example 1 on a base paper carrying an embossed pattern proved that the texture of the base paper was not damaged and the recording medium showed properties good for being written on with pencil and a good printing effect without any powder fall.

EXAMPLE 7

Specimens of recording medium were prepared as in Example 1 except that the base paper of Example I was replaced by paper having a basis weight of 127 $g/m^2$ and a Stöckigt sizing degree of 380 seconds and an ink receiving layer was formed thereon. The obtained specimens of recording medium were used for image formation as in Example 1 and evaluated for items (a) through (d). Table 2 summarily shows the results.

By measuring the pore size distribution of the specimens, it was found that the pore size distribution curve had two peaks showing maximum values. The peak that appeared at the larger pore radius size was attributable to the voids of the base paper and showed a maximum value of 2,250 nm and the other peak was attributable to the pores of the ink receiving layer and showed a maximum value of 11.8 nm. The pore volume of the ink receiving layer was equal to 0.00417 $cm^3/g$. The above observation and measurement were conducted in the same manner as in Example 1. The recording medium of this example, which was produced by forming an ink receiving layer on base paper having a high Stöckigt sizing degree, proved that the texture of the base paper was not damaged and the recording medium showed properties good for being written on with pencil and a good printing effect without any powder fall.

COMPARATIVE EXAMPLE 3

Specimens of recording medium prepared in this example were made to show a pore size distribution curve where the peak attributable to the ink receiving layer had a maximum value at the position of pore radius greater than 50 nm. The obtained specimens of recording medium were used for image formation as in Example 1 and evaluated for items (a) through (d). Table 2 summarily shows the results.

The peak value of the pore size distribution of this example was regulated by adding the cationic substance in an amount twice as much as that of Example 1 without using the binder to cause strong agglomeration to take place.

| | |
|---|---|
| inorganic pigment (15% alumina hydrate solution) | 100 weight portions |
| permeation aid (polyoxyethylenepolypropylene condensate) | 4 weight portions |
| cationic substance (benzalkonium chloride) | 4 weight portions |
| water | 125 weight portions |

The produced ink receiving layer showed a film thickness of 2.0 μm. By measuring the pore size distribution of the specimens, it was found that the pore size distribution curve had two peaks showing maximum values. The peak that appeared at the larger pore radius size was attributable to the voids of the base paper and showed a maximum value of 2510 nm and the other peak was attributable to the pores of the ink receiving layer and showed a maximum value of 89 nm. The pore volume of the ink receiving layer was equal to 0.0079 cm3/g. The above observation and measurement were conducted in the same manner as in Example 1.

As described above, according to the invention, there is provided a recording medium comprising a base member mainly made of pulp fibers and a specifically designed ink receiving layer formed thereon and made of an inorganic pigment and a binder. Thus, a recording medium according to the invention is free from the above identified problems of the prior art, has physical properties good for being written on with pencil and shows an excellent ink absorbing effect without relying largely on the absorptive power of the base paper and a high ink absorption rate without damaging the natural texture of the base paper. Moreover, it is adapted to high speed printing with a reduced number of passes and provides a high image density, a sharp color tone and a high resolution without blurs and stripy unevenness of printed images. According to the invention, there is also provided a method of manufacturing a recording medium that shows such excellent properties even if any of various known different base member in terms of Stöckigt sizing degree and surface profile were used. According to the invention, there is also provided an image forming method that can produce such high quality images.

TABLE 1

| Items | | Ex. 1 | Com. Ex. 1 | Com. Ex. 2 | Ex. 2 | Ex. 3 |
|---|---|---|---|---|---|---|
| (1) texture and colors | | ○ | X | ○ | ○ | ○ |
| (2) pencil writing | | ○ | X | ○ | ○ | ○ |
| (3) powder fall | | ○ | ○ | X | ○ | ○ |
| (4) Printing performance | (a) blur, beading | ○ | Δ | Δ | ○ | ◎ |
| | (b) Image density | 1.56 | 1.52 | 1.50 | 1.60 | 1.58 |
| | (c) water resistance | ○ | ○ | X | ○ | ○ |
| | (d) high speed printing | ○ | X | X | ○ | ○ |
| Evaluation | | good | no good | no good | good | good |

TABLE 2

| Items | | Ex. 4 | Ex. 5 | Ex. 6 | Ex. 7 | Com. Ex. 3 |
|---|---|---|---|---|---|---|
| (1) texture and colors | | ○ | ○ | ○ | ○ | Δ |
| (2) pencil writing | | ○ | ○ | ○ | ○ | Δ |
| (3) powder fall | | ○ | ○ | ○ | ○ | Δ |
| (4) Printing performance | (a) blur, beading | ○ | ○ | ○ | ○ | X |
| | (b) Image density | 1.48 | 2.43 | 1.53 | 1.56 | 1.39 |
| | (c) water resistance | ○ | ○ | ○ | ○ | ○ |
| | (d) high speed printing | ○ | ○ | ○ | ○ | Δ |
| Evaluation | | good | good | good | good | no good |

What is claimed is:

1. A recording medium comprising a base member comprising pulp fibers and an ink receiving layer formed thereon containing an inorganic pigment and a binder, the coating rate of said ink receiving layer being between 1 and 10 g/m$^2$, the pore size distribution of the recording medium consisting of a peak in pore radius distribution of the base member and a peak in pore radius distribution of the ink receiving layer, the peak in the pore radius distribution of the ink receiving layer being in the range between 8 nm and 50 nm, and the peak in the pore radius distribution of said base member being in the range between 500 nm and 10,000 nm.

2. A recording medium according to claim 1, wherein the total volume of pores with a pore radius between 8 nm and 50 nm is not less than 0.005 cm$^3$/g in said ink receiving layer.

3. A recording medium according to claim 1, wherein the ratio of the total pore volume of the ink receiving layer to that of the base member is not higher than 1/10.

4. A recording medium according to claim 1, wherein said ink receiving layer further contains a cationic substance.

5. A recording medium according to claim 1, wherein said ink receiving layer further contains a permeation aid.

6. A recording medium according to claim 1, wherein the surface of said base member is covered by said ink receiving layer by not less than 90%.

7. A recording medium according to claim 1, wherein micro-cracks are formed on the surface of said ink receiving layer.

8. An image forming method comprising the step of applying ink to a recording medium according to any of claims 1 through 7.

9. An image forming method according to claim 8, wherein an ink-jet recording method is used for applying ink to said recording medium.

10. An image forming method according to claim 9 wherein said ink-jet recording method is adapted to apply thermal energy to ink so as to make it discharge ink droplets.

11. A method of manufacturing a recording medium having a base member mainly made of pulp fibers and an ink receiving layer formed thereon, said ink receiving layer being formed by preparing a coating formulation of dispersion containing at least an inorganic pigment and resin emulsion;

applying said coating formulation to said base member at a rate between 1 and 10 g/m$^2$ after drying;

causing said inorganic pigment and said resin emulsion to weakly agglomerate; and drying the coating formulation;

the pore size distribution of the recording medium consisting of a peak in pore radius distribution of the base member and a peak in pore radius distribution of the ink receiving layer, the peak in the pore radius distribution of the ink receiving layer being in the range between 8 nm and 50 nm, and the peak in pore radius distribution of said base member being in the range between 500 nm and 10,000 nm.

12. A method of manufacturing a recording medium according to claim 11, wherein said inorganic pigment has a pore volume per unit weight between 0.1 and 3.0 cm$^3$/g.

13. A method of manufacturing a recording medium, according to claim 11 wherein said inorganic pigment has a BET specific surface area between 10 and 500 m$^2$/g.

14. A method of manufacturing a recording medium according to claim 11, wherein said inorganic pigment contains at least aluminum hydrate and/or silica.

15. A method of manufacturing a recording medium according to claim 11, wherein said binder contains an ingredient whose hydrophilicity and hydrophobicity reversibly switch at a given temperature.

16. A method of manufacturing a recording medium according to claim 11, wherein said binder has a glass transition temperature between 20° C. and 120° C.

* * * * *

UNITED STATES PATENT AND TRADEMARK OFFICE

CERTIFICATE OF CORRECTION

PATENT NO. : 7,060,335 B2
APPLICATION NO. : 09/742325
DATED : June 13, 2006
INVENTOR(S) : Hirofumi Ichinose It is certified that error appears in the above-identified patent and that said Letters Patent is hereby corrected as shown below:

COLUMN 1:
Line 32, “cost-lower” should read --cost lower--.
Line 64, “g/m2.” should read --g/$m^2$.--.
Line 67, “glm2.” should read --g/$m^2$.--.

COLUMN 2:
Line 19, “Stökgt” should read --Stöckigt--.
Line 20, “Stökgt” should read --Stöckigt--.

COLUMN 3:
Line 48, “base-paper-used” should be deleted.

COLUMN 4:
Line 22, “controlling” should read --controlling the--.

COLUMN 5:
Line 37, “ink receiving” should read --the ink receiving--.

COLUMN 8:
Line 37, “quatemary” should read --quarternary--.
Line 63, “alkyl ate quatemary” should read --alkylate quarternary--.
Line 65, “quatemary” should read --quarternary--.

COLUMN 9:
Line 65, “anti foaming” should read --anti-foaming--.

COLUMN 12:
Line 3, “(S000:” should read --(S-5000:--.
Line 40, “$cm^2$” should read --$cm^3$--

COLUMN 13:
Line 43, “used;” should read --used:--.
Line 45, “C. I” should read --C. I.--.

COLUMN 15:
Line 43, “0.00010” should read --0.0010--.
Line 57, “$cm^2$” should read --$cm^3$--.
Line 58, “$cm^2$/g” should read --$cm^3$/g--.

UNITED STATES PATENT AND TRADEMARK OFFICE

CERTIFICATE OF CORRECTION

PATENT NO. : 7,060,335 B2
APPLICATION NO. : 09/742325
DATED : June 13, 2006
INVENTOR(S) : Hirofumi Ichinose It is certified that error appears in the above-identified patent and that said Letters Patent is hereby corrected as shown below:

COLUMN 16:
Line 33, "$cm^{3/}g$" should read --$cm^3/g$--.
Line 63, "used;" should read --used:--.

COLUMN 17:
Line 67, "Example I" should read --Example 1--.

COLUMN 18:
Line 54, "cm3/g" should read --$cm^3/g$--.

COLUMN 20:
Line 45, "medium," should read --medium--.
Line 46, "claim 11" should read --claim 11,--.

Signed and Sealed this

Third Day of July, 2007

JON W. DUDAS
*Director of the United States Patent and Trademark Office*